US005511312A

United States Patent [19]

Hobbs

[11] Patent Number: 5,511,312

[45] Date of Patent: Apr. 30, 1996

[54] HINGE MORTISE CUTTER TOOL

[76] Inventor: David W. Hobbs, 1 Cawnpore Cottages, Fletching, Uckfield, East Sussex, England, TN22 3SU

[21] Appl. No.: 344,966

[22] Filed: Nov. 25, 1994

[51] Int. Cl.[6] ..... B25D 3/00; B27M 3/00

[52] U.S. Cl. ..... 30/167.1; 33/197; 144/27

[58] Field of Search ..... 33/197, 562; 144/2 R, 144/27, 67, 68, 75, 76, 84; 30/167, 167.1, 361

[56] References Cited

U.S. PATENT DOCUMENTS

| | | | |
|---|---|---|---|
| 1,179,723 | 4/1916 | Helfant | 144/76 |
| 1,251,693 | 1/1918 | Pummill | 30/167.1 |
| 1,297,577 | 3/1919 | Laird | 144/76 |
| 2,500,800 | 3/1950 | Carlson | 144/27 |
| 2,717,618 | 9/1955 | Polkosnik | 30/167.1 |
| 2,794,461 | 6/1957 | Kozlowski | 30/167.1 |
| 2,804,106 | 8/1957 | Manno | 30/167.1 |
| 3,850,211 | 11/1974 | Ganier | 144/27 |
| 4,235,268 | 11/1980 | Savary | 144/75 |
| 5,067,537 | 11/1991 | Offner . | |
| 5,072,488 | 12/1991 | Winyard . | |
| 5,146,961 | 9/1992 | Schoeller . | |
| 5,154,214 | 10/1992 | Hagerman . | |
| 5,219,011 | 6/1993 | Speck . | |

*Primary Examiner*—W. Donald Bray

[57] ABSTRACT

A hinge mortise cutter apparatus is adapted for cutting a hinge mortise into an edge of a door and includes a mortise outline cutter assembly which is placed on the edge of the door for cutting the mortise outline in the edge of the door. After the mortise outline is cut into the edge of the door, the mortise outline cutter assembly is removed from the door. The mortise outline has a predetermined length. Then, a screw-controlled mortise cutter assembly is placed over the mortise outline on the edge of the door and over a portion of two sides of the door adjacent to the edge, wherein a portion of the screw-controlled mortise cutter assembly is placed in registration with the mortise outline. Then, a screw-controlled blade assembly is advanced in a plane parallel to the edge below the edge so that a blade edge, which is part of the screw-controlled blade assembly, cuts out a mortise from the edge of the door. The blade edge has a predetermined length substantially equal to the predetermined length of the mortise outline. An alignment assembly is connected substantially perpendicularly to the support block for maintaining the mortise-outline cutter blade in a substantially perpendicular orientation with respect to the edge of the door.

5 Claims, 5 Drawing Sheets

FIG 3
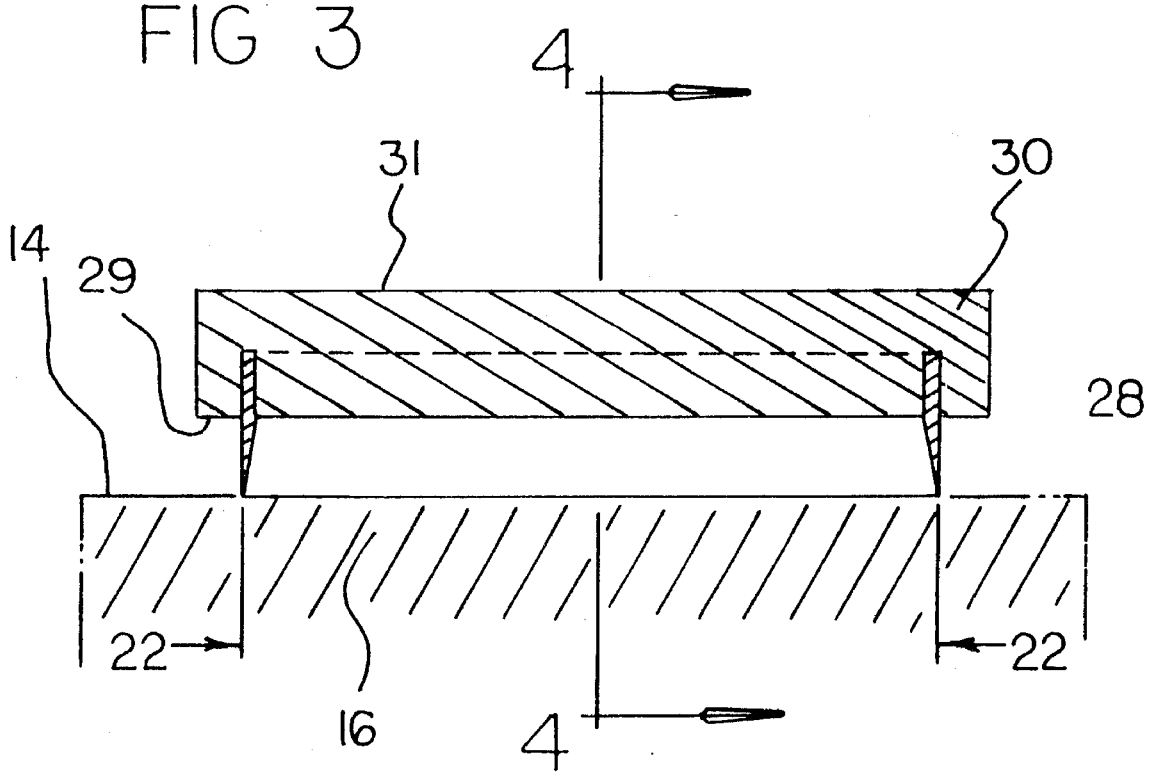
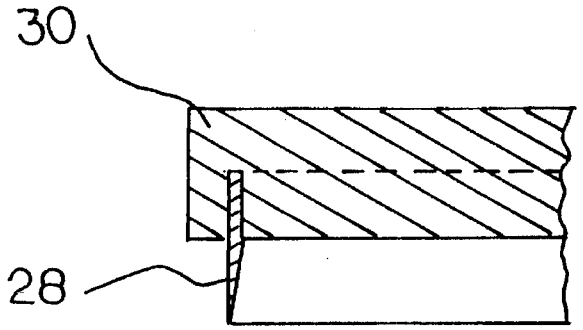
FIG 4

FIG 7
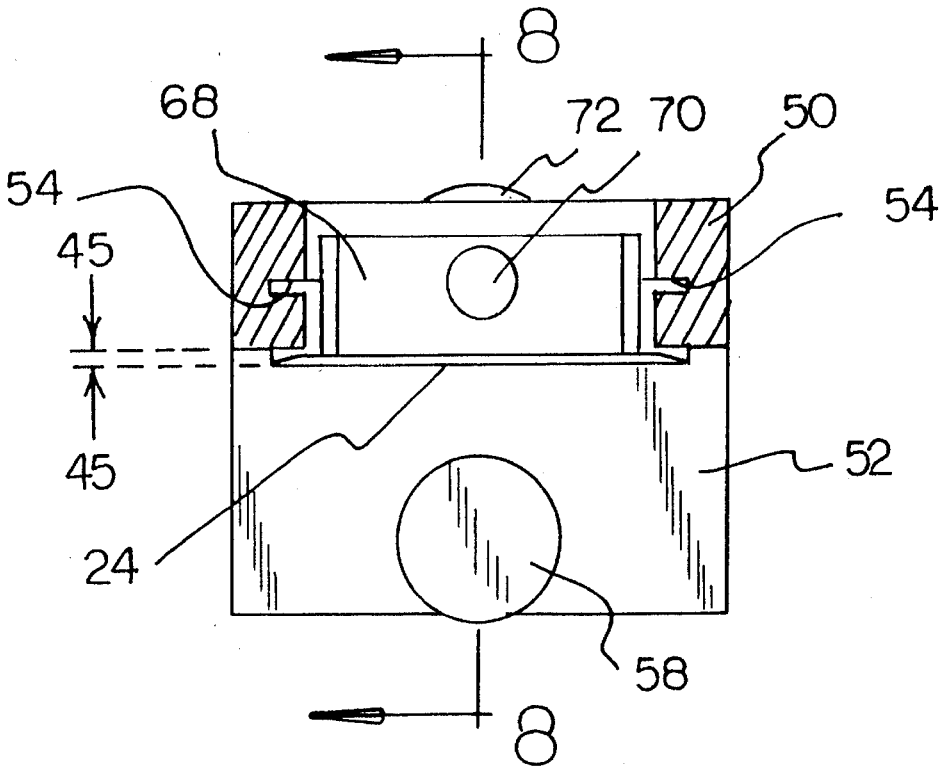
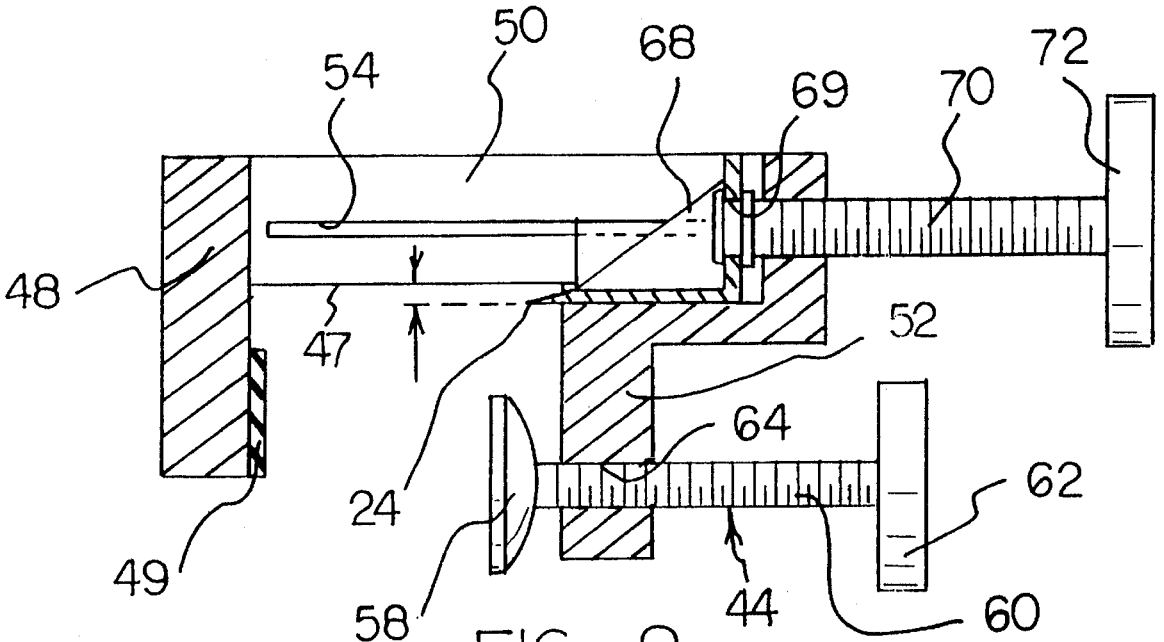
FIG 8

FIG 9
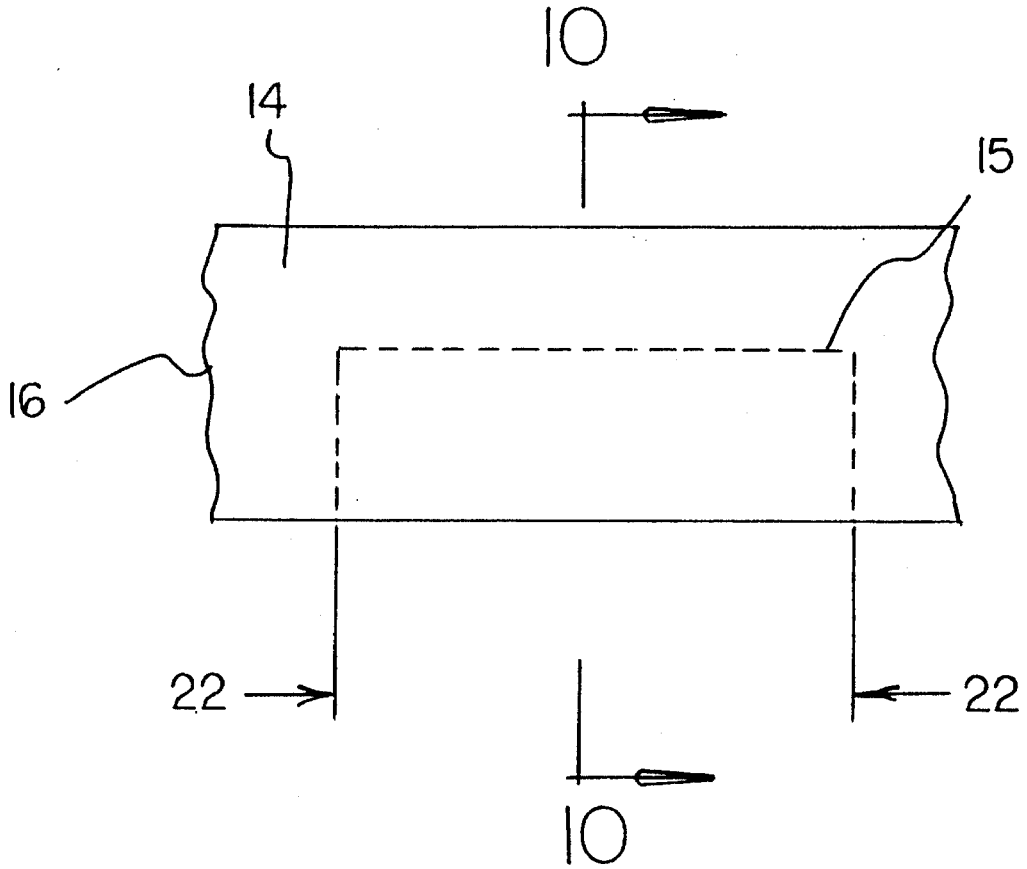
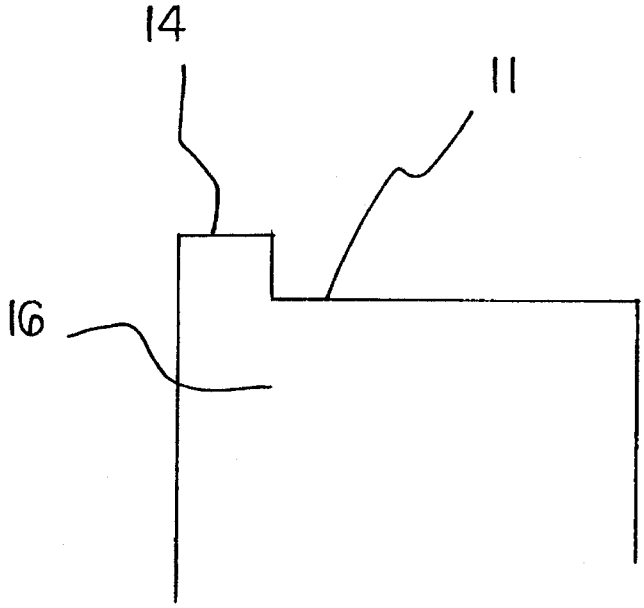
FIG 10

HINGE MORTISE CUTTER TOOL

BACKGROUND OF THE INVENTION

1. Field of the Invention

The present invention relates generally to carpentry devices and, more particularly, to devices especially adapted for aiding a person in installing a hinge on a door.

2. Description of the Prior Art

In the field of carpentry, one task which occurs often is the installation of a hinge on a door. Often the door is made of wood and the hinge-receiving edge of the door is a smooth surface out of which a quantity of wood must be cut to provide a space, or mortise, for the door-mounted portion of the hinge. In a prior art method of providing a mortise on an edge of a door, an outline of the mortise is scribed, and a quantity of wood is chiseled out of the door edge within the confines of the outlined scribed area. Several disadvantages may result from using the above-mentioned prior art method. The chisel may not be properly aligned with the outlined scribed area. Moreover, the depth at which the chisel penetrates the edge of the door is difficult to control. As a result, the chiseled out mortise region may have a rough edge and an uneven lower surface. In this respect, it would be desirable for an apparatus to be provided which permits a mortise region for an edge of a door to have a smooth edge and an even lower surface.

Throughout the years, a number of innovations have been developed relating to providing mortises on door edges, and the following U.S. Pat. Nos. are representative of some of those innovations: 5,067,537; 5,072,488; 5,146,961; 5,154,214; and 5,219,011. More specifically, U.S. Pat. Nos. 5,067,537, 5,146,961, and 5,154,214 disclose jigs mounted on doors which provide a guide for a router to cut out a mortise. Yet, none of these jig devices provides a manually operated cutting device for cutting an outline of mortise. Moreover, none of these jig devices provides a manually powered cutting device for cutting out a quantity of wood to provide the mortise. In this respect, it would be desirable for an apparatus to provide a manually operated cutting device for cutting an outline of a mortise. In addition, it would be desirable for an apparatus to provide a manually powered cutting device for cutting out a quantity of wood to provide the mortise.

U.S. Pat. No. 5,072,488 may be of interest for its disclosure of a method and apparatus for mounting hinges to a door frame. U.S. Pat. No. 5,219,011 may also be of interest for its disclosure of a table-like hinge slotting machine that accommodates power tools for cutting hinge slots and requires a door to be laid upon the table-like machine.

Still other features would be desirable in a hinge mortise cutter apparatus. For cutting out wood from a door edge to provide a mortise, the prior art provides the use of either a chisel that is struck by a hammer or an electrically powered router. A chisel that is struck by a hammer is hard to control because it is hard to control the percussive force of the hammer on the chisel. An electrically powered router may be inconvenient in many locations where electric power is not readily available. In this respect, it would be desirable for an apparatus to be provided which permits a mortise region for an edge of a door to be cut without the use of a chisel that is struck by a hammer. Moreover, it would be desirable for an apparatus to be provided which permits a mortise region for an edge of a door to be cut without using an electrically powered router.

A screw is an easily controlled, force-multiplying, simple machine. As such, it would be desirable if a screw could be utilized for controlling cutting out of wood from a door edge to provide a mortise for a hinge.

As stated above, providing a mortise for a door hinge requires providing an outline and cutting out the mortise. Because these two operations go hand in hand, it would be desirable for a kit to be provided that includes both apparatus for providing a mortise outline and apparatus for cutting the mortise out of the door edge.

Thus, while the foregoing body of prior art indicates it to be well known to use jigs for cutting out mortises on the edge of a door, the prior art described above does not teach or suggest a hinge mortise cutter apparatus which has the following combination of desirable features: (1) enables a mortise region for an edge of a door to have a smooth edge and an even lower surface; (2) provides a manually operated cutting device for cutting an outline of a mortise; (3)provides a manually powered cutting device for cutting out a quantity of wood to provide the mortise; (4) permits a mortise region for an edge of a door to be cut without the use of a chisel that is struck by a hammer; (5) permits a mortise region for an edge of a door to be cut without using an electrically powered router; (6) utilizes a screw for cutting out wood from a door edge to provide a mortise; and (7) provides a kit that includes both apparatus for providing a mortise outline and apparatus for curing the mortise out of the door edge. The foregoing desired characteristics are provided by the unique hinge mortise cutter apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a hinge mortise cutter apparatus which is adapted for cutting a hinge mortise into an edge of a door and which includes a mortise outline cutter assembly which is placed on the edge of the door for cutting the mortise outline in the edge of the door. After the mortise outline is cut into the edge of the door, the mortise outline cutter assembly is removed from the door. The mortise outline has a predetermined length. Then, a screw-controlled mortise cutter assembly is placed over the mortise outline on the edge of the door and over a portion of two sides of the door adjacent to the edge, wherein a portion of the screw-controlled mortise cutter assembly is placed in registration with the mortise outline. Then, a screw-controlled blade assembly is advanced in a plane parallel to the edge below the edge so that a blade edge, which is part of the screw-controlled blade assembly, cuts out a mortise from the edge of the door. The blade edge has a predetermined length substantially equal to the predetermined length of the mortise outline.

The mortise outline cutter assembly includes a mortise-outline cutter blade and a support block which supports the mortise-outline cutter blade. The support block includes a bottom portion adapted to support the mortise-outline cutter blade and a top portion adapted to receive percussive strikes, such as from a hammer. An alignment assembly is connected substantially perpendicularly to the support block for maintaining the mortise-outline cutter blade in a substantially perpendicular orientation with respect to the edge of the door. The alignment assembly is adapted to simultaneously contact the support block and a side of the door adjacent to the portion of the edge of the door contacted by the mortise-outline cutter blade. The mortise-outline cutter blade is rectangular shaped, wherein one side of a rectangle is the predetermined length.

The support block includes two projection portions that project past the side of the door, and the alignment assembly includes two channels adapted to receive the two projection portions of the support block. The screw-controlled mortise cutter assembly includes a bracket assembly adapted to fit over a portion of the edge of the door adjacent to the mortise outline and adapted to contact portions of the two sides of the door adjacent to the mortise outline. The bracket assembly includes a guide portion adapted for guiding the screw-controlled blade assembly in a plane parallel to the edge of the door as the screw-controlled blade assembly cuts into the door to form the mortise. A clamp assembly, supported by the bracket assembly, is adapted for clamping the bracket assembly onto the door.

The bracket assembly includes a first projecting portion, a transverse portion connected to the first projecting portion, and a second projecting portion connected to the transverse portion. The transverse portion includes a pair of opposed groove portions adapted to receive complementary tongue portions of the screw-controlled blade assembly. The groove portions serve as the guide portion adapted for guiding the blade edge of the screw-controlled blade assembly in a plane parallel to the edge of the door as the blade edge cuts into the door to form the mortise. The groove portions extend along the transverse portion of the bracket assembly in a plane parallel to the edge of the door.

The clamp assembly includes a clamping foot adapted to contact a side of the door. A screw portion is connected to the clamping foot, and a handle portion is connected to the screw portion. The second projecting portion of the transverse portion includes a threaded channel that is complementarily threaded to receive the screw portion of the clamp assembly.

The transverse portion of the bracket assembly includes a threaded channel, and the screw-controlled blade assembly includes the blade edge. A blade-support block supports the blade edge. A threaded shaft is connected to the blade-support block and passes through the threaded channel of the transverse portion of the bracket assembly. A handle is connected to the threaded shaft.

In accordance with another aspect of the invention, a mortise outline cutter assembly apparatus, as described above, is provided that is adapted for placement on the edge of a door for cutting a mortise outline in the edge of the door and includes a mortise-outline cutter blade.

In accordance with yet another aspect of the invention, a screw-controlled mortise cutter assembly apparatus, as described above, is adapted to fit over a portion of an edge of a door adjacent to a mortise outline for cutting a mortise in the door.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hinge mortise cutter apparatus which has all of the advantages of the prior art and none of the disadvantages.

It is another object of the present invention to provide a new and improved hinge mortise cutter apparatus which may be easily and efficiently manufactured and marketed.

It is a further object of the present invention to provide a new and improved hinge mortise cutter apparatus which is of durable and reliable construction.

An even further object of the present invention is to provide a new and improved hinge mortise cutter apparatus which is susceptible of a low cost of manufacture with regard to both materials and labor, and which accordingly is then susceptible of low prices of sale to the consuming public, thereby making such hinge mortise cutter apparatus available to the buying public.

Still yet a further object of the present invention is to provide a new improved hinge mortise cutter apparatus which enables a mortise region for an edge of a door to have a smooth edge and an even lower surface.

Still another object of the present invention is to provide a new and improved hinge mortise cutter apparatus that provides a manually operated cutting device for cutting an outline of a mortise.

Yet another object of the present invention is to provide a new and improved hinge mortise cutter apparatus which provides a manually powered cutting device for cutting out a quantity of wood to provide the mortise.

Even another object of the present invention is to provide a new and improved hinge mortise cutter apparatus that permits a mortise region for an edge of a door to be cut without the use of a chisel that is struck by a hammer.

Still a further object of the present invention is to provide a new and improved hinge mortise cutter apparatus which permits a mortise region for an edge of a door to be cut without using an electrically powered router.

Yet another object of the present invention is to provide a new and improved hinge mortise cutter apparatus that utilizes a screw for cutting out wood from a door edge to provide a mortise.

Still another object of the present invention is to provide a new and improved hinge mortise cutter apparatus which provides a kit that includes both apparatus for providing a mortise outline and apparatus for cutting the mortise out of the door edge.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is a cross-sectional view of the embodiment of the mortise outline cutter assembly shown in FIG. 2 taken along line 3—3 thereof.

FIG. 4 is a cross-sectional view of the embodiment of the mortise outline cutter assembly shown in FIG. 3 taken along line 3—3 thereof.

FIG. 7 is a cross-sectional view of the embodiment of the screw-controlled mortise cutter assembly shown in FIG. 6 taken along line 7—7 thereof.

FIG. 8 is a cross-sectional view of the embodiment of the screw-controlled mortise cutter assembly shown in FIG. 7 taken along line 8—8 thereof.

FIG. 9 is a top view of a portion of a door showing a mortise outline made by the mortise outline cutter assembly of the invention.

FIG. 10 is a partial cross-sectional view of the door shown in FIG. 9, taken along line 9—9, showing a mortise cut out of the door by the screw-controlled mortise cutter assembly of the invention.

DESCRIPTION OF THE PREFERRED EMBODIMENT

Figure 1:
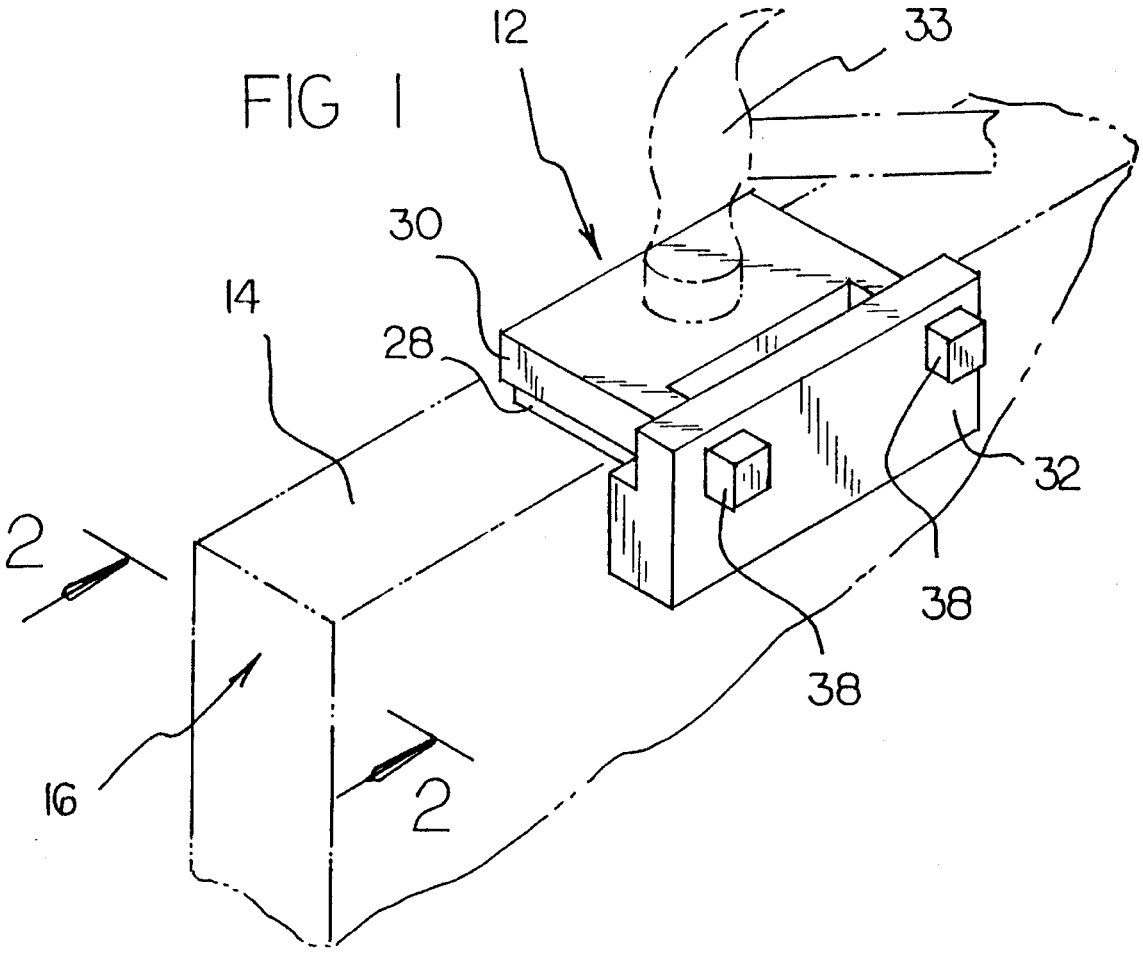
FIG. 1 is a perspective view showing a preferred embodiment of a mortise outline cutter assembly of the hinge mortise cutter apparatus of the invention being used on the edge of a door.
Figure 2:
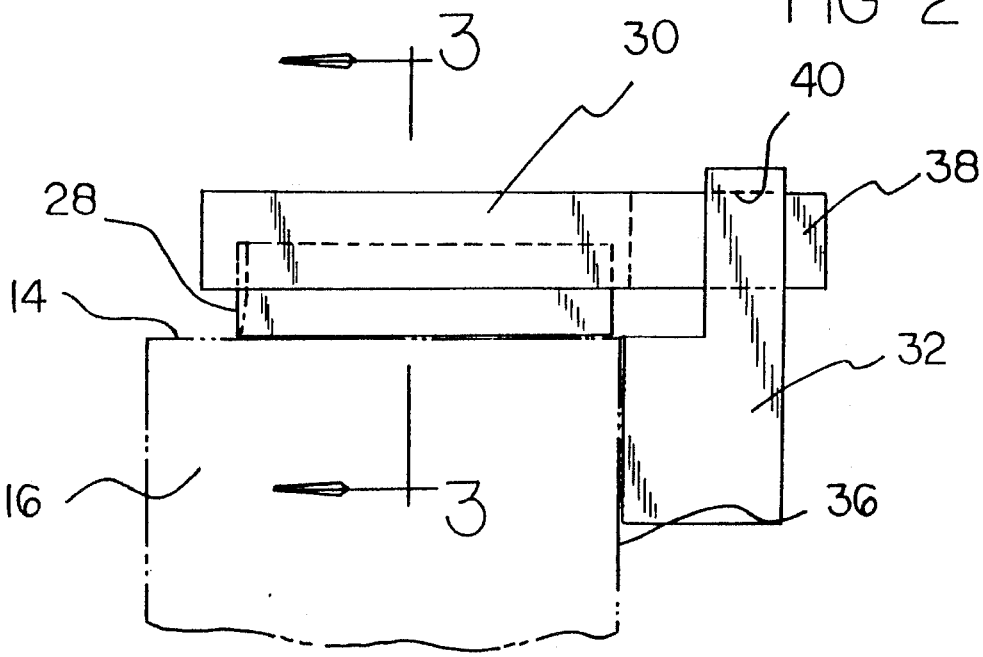
FIG. 2 is an enlarged side view of the embodiment of the mortise outline cutter assembly of the invention shown in FIG. 1 taken along line 2—2 of FIG. 1.

With reference to the drawings, a new and improved hinge mortise cutter apparatus embodying the principles and concepts of the present invention will be described.

Turning to FIGS. 1–10, there is shown an exemplary embodiment of the hinge mortise cutter apparatus of the invention generally designated by reference numeral 10. More specifically, the hinge mortise cutter apparatus 10 is adapted for cutting a hinge mortise 11 into an edge 14 of a door 16. Generally, the hinge mortise cutter apparatus 10 is comprised of a kit that includes a mortise outline cutter assembly 12 and a screw-controlled mortise cutter assembly 18.

As shown in FIGS. 1–4, a mortise outline cutter assembly 12 is placed on the edge 14 of the door 16 for cutting the mortise outline 15 in the edge 14 of the door 16. After the mortise outline 15 is cut into the edge 14 of the door 16, the mortise outline cutter assembly 12 is removed from the door 16. The mortise outline 15 has a predetermined length 22. The mortise outline 15 is shown in FIG. 9.

Then, as shown in FIGS. 5–8, a screw-controlled mortise cutter assembly 18 is placed over the mortise outline 15 on the edge 14 of the door 16 and over a portion of two sides of the door 16 adjacent to the edge 14, wherein a portion of the screw-controlled mortise cutter assembly 18 is placed in registration with the mortise outline 15. Then, a screw-controlled blade assembly 20 is advanced in a plane parallel to the edge 14 below the edge 14 so that a blade edge 24, which is part of the screw-controlled blade assembly 20, cuts out a mortise 11 from the edge 14 of the door 16. The mortise 11 is shown in FIG. 10. The blade edge 24 has a predetermined length substantially equal to the predetermined length 22 of the mortise outline 15.

More specifically, the mortise outline cutter assembly 12 includes a mortise-outline cutter blade 28. A support block 30 supports the mortise-outline cutter blade 28. The support block 30 includes a bottom portion 29 adapted to support the mortise-outline cutter blade 28 and a top portion 31 adapted to receive percussive strikes, such as from a hammer 33.

An alignment assembly 32 is connected substantially perpendicularly to the support block 30 for maintaining the mortise-outline cutter blade 28 in a substantially perpendicular orientation with respect to the edge 14 of the door 16. The alignment assembly 32 is adapted to simultaneously contact the support block 30, and a side 36 of the door 16 adjacent to the portion of the edge 14 of the door 16 is contacted by the mortise-outline cutter blade 28. The mortise-outline cutter blade 28 is rectangular shaped, wherein one side of a rectangle is the predetermined length 22. The mortise-outline cutter blade 28 can fit into the support block 30 by a friction fit.

The support block 30 includes two projection portions 38 that project past the side 36 of the door 16, and the alignment assembly 32 includes two channels 40 adapted to receive the two projection portions 38 of the support block 30.

Further as shown in FIGS. 5–8, the screw-controlled mortise cutter assembly 18 includes a bracket assembly 42 adapted to fit over a portion of the edge 14 of the door 16 adjacent to the mortise outline 15 and adapted to contact portions of the two sides of the door 16 adjacent to the mortise outline 15. The bracket assembly 42 includes a guide portion adapted for guiding the screw-controlled blade assembly 20 in a plane parallel to the edge 14 of the door 16 as the screw-controlled blade assembly 20 cuts into the door 16 to form the mortise 11. A clamp assembly 44, supported by the bracket assembly 42, is adapted for clamping the bracket assembly 42 onto the door 16.

The bracket assembly 42 includes a first projecting portion 48, a transverse portion 50 connected to the first projecting portion 48, and a second projecting portion 52 connected to the transverse portion 50. The transverse portion 50 includes a pair of opposed groove portions 54 adapted to receive complementary tongue portions 56 of the screw-controlled blade assembly 20. The groove portions 54 serve as the guide portion adapted for guiding the blade edge 24 of the screw-controlled blade assembly 20 in a plane parallel to the edge 14 of the door 16 as the blade edge 24 cuts into the door 16 to form the mortise 11. The groove portions 54 extend along the transverse portion 50 of the bracket assembly 42 in a plane parallel to the edge 14 of the door 16.

The clamp assembly 44 includes a clamping foot 58 adapted to contact a side of the door 16. A screw portion 60 is connected to the clamping foot 58, and a handle portion 62 is connected to the screw portion 60. The second projecting portion 52 of the transverse portion 50 includes a threaded channel 64 that is complementarily threaded to receive the screw portion 60 of the clamp assembly 44.

The transverse portion 50 of the bracket assembly 42 includes a threaded channel 66, and the screw-controlled blade assembly 20 includes the blade edge 24. A blade-support block 68 supports the blade edge 24. A threaded shaft 70 is connected to the blade-support block 68 and passes through the threaded channel 66 of the transverse portion 50 of the bracket assembly 42. A handle 72 is connected to the threaded shaft 70.

The blade-support block 68 includes an aperture 69 through which an end portion of the threaded shaft 70 passes. Raised flange areas at the end portion of the threaded shaft 70 retain the end portion of the threaded shaft 70 in the aperture 69 and permit the end portion of the threaded shaft 70 to rotate in the aperture 69 as the blade-support block 68 is moved toward and away from the first projecting portion 48 of the bracket assembly 42.

In using the hinge mortise cutter apparatus 10 of the invention, the mortise outline cutter assembly 12 is first placed on the edge 14 of the door 16 as shown in FIG. 1 at the location where a mortise 11 is desired. The alignment assembly 32 is placed over the two projection portions 38 of the support block 30 to make sure that the mortise-outline cutter blade 28 is oriented perpendicular to the edge 14 of the door 16. The mortise-outline cutter blade 28 is rectangularly shaped to cut the outline of a rectangular mortise 11 for a door hinge. A hammer 33 is struck on the top portion 31 of the support block 30 thereby driving the mortise-outline cutter blade 28 into the edge 14 of the door 16 to provide a mortise outline 15 in the edge 14.

Figure 5:
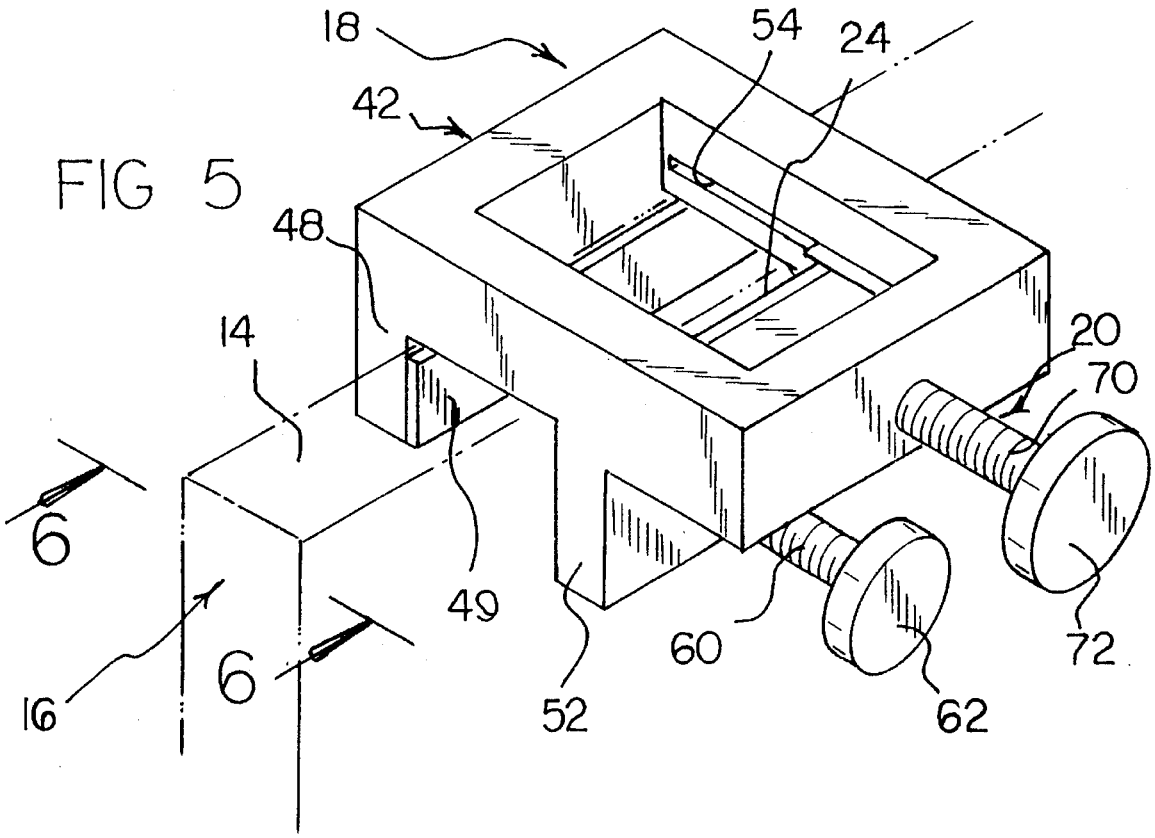
FIG. 5 is a perspective view showing a preferred embodiment of a screw-controlled mortise cutter assembly of the hinge mortise cutter apparatus of the invention being used on the edge of a door.
Figure 6:
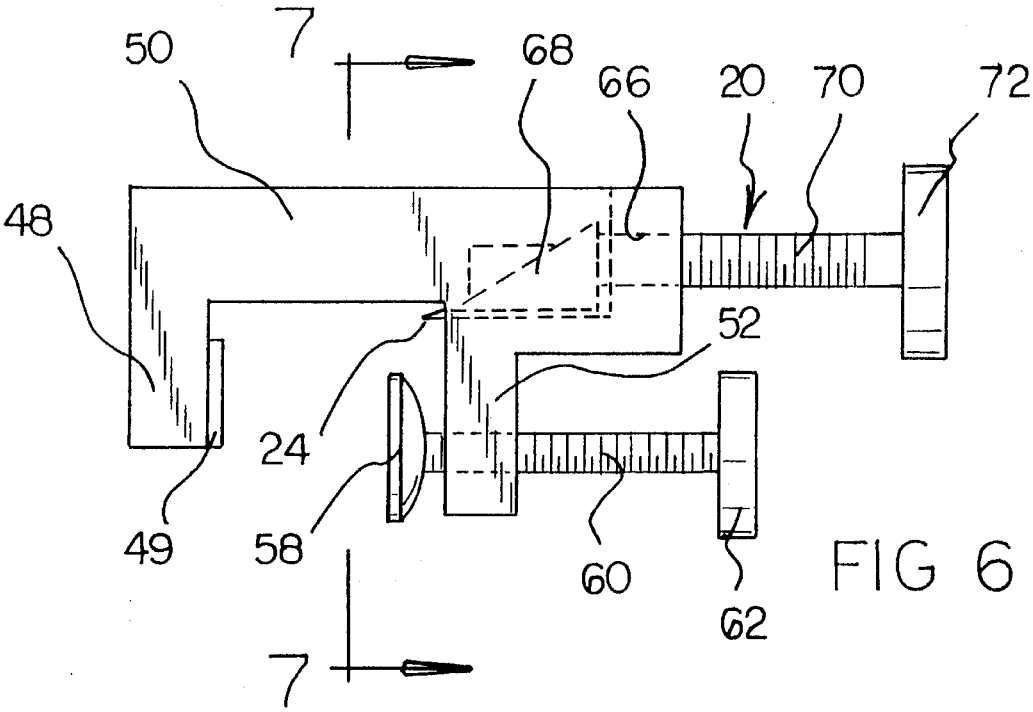
FIG. 6 is an enlarged side view of the embodiment of the screw-controlled mortise cutter assembly of the invention shown in FIG. 5 taken along line 6—6 of FIG. 5.

After the mortise outline 15 is cut into the edge 14 of the door 16, the mortise outline cutter assembly 12 is removed, and the screw-controlled mortise cutter assembly 18, as shown in FIG. 5, is placed on the top of the door 16. First, the handle portion 62 is turned counterclockwise to assure that the clamping foot 58 clears the door 16. Then, the handle portion 62 is turned clockwise to turn the screw portion 60 and turn the clamping foot 58 toward the side wall of the door 16. This clamps the bracket assembly 42 onto the door 16. More specifically, the door 16 is clamped between the second projecting portion 52 and the first projecting portion 48 of the bracket assembly 42. A pad 49 is provided on the inside surface of the first projecting portion 48 of the bracket assembly 42.

Once the screw-controlled mortise cutter assembly 18 is installed on the door 16, the handle 72 of the screw-controlled blade assembly 20 is turned clockwise to turn the threaded shaft 70 and advance the blade-support block 68 and the blade edge 24 toward the door 16. With further turning of the handle 72, the blade edge 24 cuts into the door 16, thereby cutting out a mortise 11 in the door 16. The predetermined length 22 of the mortise outline 15 is equal to the length of the blade edge 24 so that the length of the mortise 11 is equal to the predetermined length 22. After the mortise 11 is completely cut out, the handle 72 is turned counterclockwise to retract the blade edge 24 back to its initial position.

The depth of the mortise 11 in the edge 14 of the door 16 is determined by the vertical spacing 45 between the bottom surface 47 of the transverse portion 50 of the bracket assembly 42 and the blade edge 24 of the screw-controlled blade assembly 20. If the vertical spacing 45 between the bottom surface 47 of the transverse portion 50 of the bracket assembly 42 and the blade edge 24 of the screw-controlled blade assembly 20 is increased, then the depth of the mortise 11 is increased. On the other hand, if the vertical spacing 45 between the bottom surface 47 of the transverse portion 50 of the bracket assembly 42 and the blade edge 24 of the screw-controlled blade assembly 20 is decrease, then the depth of the mortise 11 is decreased. Once the mortise 11 is made, the screw-controlled mortise cutter assembly 18 is removed from the door 16. Then. A portion of a hinge can be installed in the mortise 11.

In accordance with another aspect of the invention, a mortise outline cutter assembly apparatus 12, described above, is provided for placement on the edge 14 of a door 16 for cutting a mortise outline 15 in the edge 14 of the door 16.

In accordance with still another aspect of the invention, screw-controlled mortise cutter assembly apparatus 18, described above, is adapted to fit over a portion of an edge 14 of a door 16 adjacent to a mortise outline 15 and is adapted to cut a mortise out of the door 16.

The components of the hinge mortise cutter apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved hinge mortise cutter apparatus that is low in cost, relatively simple in design and operation, and which may advantageously be used to enable a mortise region for an edge of a door to have a smooth edge and an even lower surface. With the invention, a hinge mortise cutter apparatus provides a manually operated cutting device for cutting an outline of a mortise. With the invention, a hinge mortise cutter apparatus provides a manually powered cutting device for cutting out a quantity of wood to provide the mortise. With the invention, a hinge mortise cutter apparatus is provided which permits a mortise region for an edge of a door to be cut without the use of a chisel that is struck by a hammer. With the invention, a hinge mortise cutter apparatus is provided which permits a mortise region for an edge of a door to be cut without using an electrically powered router. With the invention, a hinge mortise cutter apparatus is provided which utilizes a screw for cutting out wood from a door edge to provide a mortise. With the invention, a hinge mortise cutter apparatus provides a kit that includes both apparatus for providing a mortise outline and apparatus for cutting the mortise out of the door edge.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A hinge mortise cutter apparatus for cutting a hinge mortise into an edge of a door, comprising:

a mortise outline cutter assembly adapted for placement on the edge of the door for cutting a mortise outline in the edge of the door and adapted for removal from the door after the mortise outline has been cut, wherein the mortise outline has a predetermined length, wherein said mortise outline cutter assembly includes a mortise-outline cutter blade, a support block which supports said mortise-outline cutter blade, wherein said support block includes a bottom portion adapted to support said mortise-outline cutter blade and a top portion adapted to receive percussive strikes, an alignment assembly, connected substantially perpendicularly to said support block, for maintaining said mortise-outline cutter blade in a substantially perpendicular orientation with respect to the edge of the door, wherein said alignment assembly is adapted to simultaneously contact said support block and a side of the door adjacent to the portion of the edge of the door contacted by said mortise-outline cutter blade, wherein said support block includes two projection portions that project past the side of the door, and said alignment assembly includes two channels adapted to receive said two protection portions of said support block, and a screw-controlled mortise cutter assembly adapted be placed over the mortise outline on the edge of the door and over a portion of two sides of the door adjacent to the edge, wherein a portion of the screw-controlled mortise cutter assembly is placed in registration with the mortise outline on the edge of the door, such that a screw-controlled blade assembly can be advanced in a plane parallel to the edge below the edge so that a blade edge, which is part of said screw-controlled blade assembly, cuts out a mortise from the edge of the door, wherein said blade edge has a predetermined length substantially equal to the predetermined length of the mortise outline, wherein said screw-controlled mortise cutter assembly includes a bracket assembly adapted to fit over a portion of the edge of the door adjacent to said mortise outline and adapted to contact portions of the two sides of the door adjacent to said mortise outline, wherein said bracket assembly includes a guide portion adapted for guiding said screw-controlled blade assembly in a plane parallel to the edge of the door as said screw-controlled blade assembly cuts into the door to form the mortise, and a clamp assembly, supported by said bracket assembly, adapted for clamping said bracket assembly onto the door, wherein said bracket assembly includes a first projecting portion, a transverse portion connected to said first projecting portion, and a second projecting portion connected to said transverse portion, said transverse portion includes a pair of opposed groove portions adapted to receive complementary tongue portions of said screw-controlled blade assembly, wherein said groove portions serve as said guide portion adapted for guiding said blade edge of said screw-controlled blade assembly in a plane parallel to the edge of the door as said blade edge cuts into the door to form the mortise, and said clamp assembly includes a clamping foot adapted to contact a side of the door, wherein said groove portions extend along said transverse portion of said bracket assembly in a plane parallel to the edge of the door, a screw portion connected to said clamping foot, and a handle portion connected to said screw portion, wherein said transverse portion of said bracket assembly includes a threaded channel, and said screw-controlled blade assembly includes said blade edge, a blade-support block supporting said blade edge, a threaded shaft connected to said blade-support block and passing through said threaded channel of said transverse portion of said bracket assembly, and a handle connected to said threaded shaft, and wherein said second projecting portion of said transverse portion a threaded channel that is complementarily threaded to receive said screw portion of said clamp assembly.

2. The apparatus of claim 1 wherein said mortise-outline cutter blade is rectangular shaped, wherein one side of a rectangle is said predetermined length.

3. A mortise outline cutter assembly apparatus adapted for placement on the edge of a door for cutting a mortise outline in the edge of the door, comprising:

a mortise-outline cutter blade, a support block which supports said mortise-outline cutter blade, wherein said support block includes a bottom portion adapted to support said mortise-outline cutter blade and a top portion adapted to receive percussive strikes, and an alignment assembly, connected substantially perpendicularly to said support block, for maintaining said mortise-outline cutter blade in a substantially perpendicular orientation with respect to the edge of the door, wherein said alignment assembly is adapted to simultaneously contact said support block and a side of the door adjacent to the portion of the edge of the door contacted by said mortise-outline cutter blade, wherein said support block includes two projection portions that project past the side of the door, and said alignment assembly includes two channels adapted to receive said two projection portions of said support block.

4. The apparatus of claim 1 wherein said mortise-outline cutter blade is rectangular shaped, wherein one side of a rectangle is said predetermined length.

5. A screw-controlled mortise cutter assembly apparatus, comprising:

a bracket assembly adapted to fit over a portion of an edge of a door adjacent to a mortise outline and adapted to contact portions of two sides of the door adjacent to the mortise outline, wherein said bracket assembly includes a guide portion adapted for guiding a screw-controlled blade assembly in a plane parallel to the edge of the door as said screw-controlled blade assembly cuts into the door to form a mortise, and a clamp assembly, supported by said bracket assembly, adapted for clamping said bracket assembly onto the door, wherein said bracket assembly includes a first projecting portion, a transverse portion connected to said first projecting portion, and a second projecting portion connected to said transverse portion, wherein said transverse portion includes a pair of opposed groove portions adapted to receive complementary tongue portions of said screw-controlled blade assembly, wherein said groove portions serve as said guide portion adapted for guiding said blade edge of said screw-controlled blade assembly in a plane parallel to the edge of the door as said blade edge cuts into the door to form the mortise, and wherein said clamp assembly includes a clamping foot adapted to contact a side of the door, a screw portion connected to said clamping foot, and a handle portion connected to said screw portion, and wherein said second projecting portion of said transverse portion a threaded channel that is complementarily threaded to receive said screw portion of said clamp assembly.

* * * * *